US006672908B2

(12) United States Patent
Okabe et al.

(10) Patent No.: US 6,672,908 B2
(45) Date of Patent: Jan. 6, 2004

(54) SUBSTRATE CONNECTOR

(75) Inventors: Toshiaki Okabe, Shizuoka-ken (JP); Tetsuya Yamashita, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 6 days.

(21) Appl. No.: 10/062,715

(22) Filed: Feb. 5, 2002

(65) Prior Publication Data

US 2002/0106940 A1 Aug. 8, 2002

(30) Foreign Application Priority Data

Feb. 6, 2001 (JP) ..... 2001-029729

(51) Int. Cl.[7] ..... H01R 33/00

(52) U.S. Cl. ..... 439/682; 439/744; 439/871; 439/296

(58) Field of Search ..... 439/682, 654, 439/655, 76.1, 76.2, 949, 252, 744, 871, 296

(56) References Cited

U.S. PATENT DOCUMENTS 4,767,342 A * 8/1988 Sato ..... 439/78
4,813,881 A * 3/1989 Kirby ..... 439/74
5,456,620 A * 10/1995 Kaminski ..... 439/654
6,315,591 B2 * 11/2001 Oda et al. ..... 439/252
6,328,614 B1 * 12/2001 Osawa ..... 439/752

* cited by examiner

*Primary Examiner*—Tho D. Ta
*Assistant Examiner*—James R. Harvey
(74) *Attorney, Agent, or Firm*—Finnegan, Henderson, Farabow, Garrett & Dunner, L.L.P.

(57) ABSTRACT

This invention provides a substrate connector (63) allowing mating terminals to be inserted into terminal accommodating chambers in the housing main body (67) from one side or the other side and comprises an insertion guide portion (75) provided around an installation opening (73) in the housing main body (67) and for guiding the mating terminals into the terminal accommodating chambers (65) when inserting the mating terminals into the terminal accommodating chambers (65) from the other side of the housing main body (67).

12 Claims, 14 Drawing Sheets

SUBSTRATE CONNECTOR

BACKGROUND OF THE INVENTION

1. Field of the Invention

The present invention relates to a substrate connector allowing mating terminals to be inserted into terminal accommodating chambers from a side or the other side of a housing main body thereof and a terminal for use in the same substrate connector.

2. Description of the Related Art

As shown in FIGS. 1A–5C, a related substrate connector comprises a housing main body 5 which is fixed on a substrate 1 and has a plurality of terminal accommodating chambers 3, terminals 7 accommodated in the plural terminal accommodating chambers 3 and a spacer member 9 which holds these terminals 7 in the housing main body 5. The housing main body 5 has insertion openings 11 provided on one side thereof for allowing plural mating terminals to be inserted into each of the terminal accommodating chambers 3, and an installation opening 13 provided on the other side for allowing plural terminals 7 to be installed in the plural terminal accommodating chambers 3. The housing main body 5 has a guide slope 14 provided on an opening edge of the insertion opening 11 for guiding insertion of a mating terminal into the terminal accommodating chamber 3.

The terminal 7 is formed on the one side and accommodated in each terminal accommodating chamber 3 of the housing main body 5 and comprises a contact portion 15 coming into contact with a mating terminal 15 and a soldering fixing portion 17, which is formed on the other side, introduced out of the installation opening 13 in the housing main body 5 and fixed on the substrate 1.

The spacer member 9 is installed in the installation opening 13 of the housing main body 5 and comprises a retaining portion 21 which is in contact with the contact portion 15 of each of the plural terminals 7 for holding the contact portion 15 in each terminal accommodating chamber 3 and introduction opening 23 for introducing a soldering fixing portion 17 of each of the plural terminals 7 out of the housing main body 5.

When connecting the plural mating terminals to the plural terminals 7 in such a substrate connector 25, the mating terminals are inserted into the plural terminal accommodating chambers 3 through the insertion opening 11 of the housing main body 5. If an interval between adjacent ones of the plural mating terminals and plural insertion openings deflects, the front end of each thereof slides on a guide slope 11 and is introduced into the terminal accommodating chamber 3. As a result, the plural mating terminals of the substrate connector 25 are inserted into the terminal accommodating chambers 3 securely, so that they come into contact with the contact portions 15 of the plural terminals 7.

In this case, the substrate connector 25 guides the mating terminals into the terminal accommodating chambers 3 through the guide slope 14 having an inclination angle and size corresponding to an interval between adjacent ones of the mating terminals. Consequently, deflection of the interval between the adjacent one of the mating terminals with respect to the terminal accommodating chambers 3 is absorbed. For the reason, in order to match plural kinds of the mating terminals different in the interval between adjacent terminals with the substrate connector 25, it is relatedly necessary to prepare plural kinds of the substrate connectors 25 different in the inclination angle and size of the guide slope 14 corresponding to the specification of the mating terminals. As a result, the substrate connector 25 induces a high cost and inconvenience in part management.

Thus, a substrate connector 27 shown in FIGS. 6, 7 is employed. The substrate connector 27 is fixed to a substrate 30 having a through hole 29 and comprises a housing main body 33 having a plurality of terminal accommodating chambers 31, a plurality of terminals 35 accommodated in the terminal accommodating chambers 31 and a spacer member 39 allowing a plurality of mating terminals 54 to be inserted from the other side of the housing main body 33 into each terminal accommodating chamber 31. The housing main body 33 has an insertion opening 41 provided on one side for allowing the mating terminals 37 to be inserted from the one side of the housing main body 33 into each of the plural terminal accommodating chambers 31 and an installation opening 43 provided on the other side for installing the plural terminals 35 into the terminal accommodating chambers 31.

The insertion opening 41 has a guide slope 45 provided on an opening edge for guiding the mating terminal into the terminal accommodating chamber 31. The installation opening 43 is disposed over a through hole 29 in the substrate 1 when the housing main body 33 is fixed on the substrate 30.

The terminals 35 are formed on the one side and accommodated in the terminal accommodating chambers 31 in the housing main body 33. The terminal 35 comprises a contact portion 47 which comes into contact with mating terminals 37, 54 and a soldering fixing portion 49 which is formed on the other side, introduced out of the installation opening 43 of the housing main body 33 and soldered on the substrate 30.

The spacer 39 is installed on the other side of the housing main body 33 so as to close the installation opening 43 in the housing main body 33. The spacer member 39 comprises a spacer main body 53, which is in contact with the contact portion 47 of the terminal 35 for holding the contact portion 47 in each of the plural terminal accommodating chambers 31, a spacer side insertion opening 55, which is provided in this spacer main body 53 and communicates the through hole 29 in the substrate 30 to the installation opening 43 of the housing main body 33 for allowing the plural mating terminals 54 to be inserted into the terminal accommodating chambers 31 from the other side and an introduction opening 57 for introducing the soldering fixing portions 49 of the plural terminals 35 out of the housing main body 33.

A guide slope 59 for guiding a mating terminal 54 into the terminal accommodating chamber 31 is provided on an opening edge of the insertion opening 41 in the spacer member 39. This guide slope 59 is different from the guide slope 45 in the housing main body 33 in inclination angle and size.

If it is intended to connect the terminals 35 to the mating terminals of an electric connecting box 60 by means of such a substrate connector 27, the substrate 30 is accommodated in an accommodating space of the electric connecting box 60 from the one side of the housing main body 33. At this time, by matching the plural insertion openings 41 in the substrate connector 27 with the mating terminals 37 of the electric connecting box 60, the mating terminals 37 are inserted into the terminal accommodating chamber 31 (see FIG. 7).

At this time, if intervals between adjacent ones of the plural mating terminals 37 and the insertion openings 41 deflect, front ends of the mating terminals 37 slide on the guide slope 45 of the housing main body 33 so that they are guided into the terminal accommodating chambers 31. As a result, the substrate connector 27 allows the mating terminals 37 to be inserted into the terminal accommodating chambers 31 from the one side of the housing main body 33 securely, so that the contact portions 47 of the terminals 35 come into contact with the mating terminals 37.

If it is intended to connect the mating terminals 37 to mating terminals 54 of an electric connecting box 61 which cannot be inserted from one side of the housing main body 33 because the interval between adjacent terminals is different from that of the former, the substrate 30 is accommodated in an accommodating space of the electric connecting box 61 from the other side of the housing main body 33. At this time, by matching the plural mating terminals 54 with the insertion openings 55 in the substrate connector 27, the mating terminals 54 are inserted in the terminal accommodating chambers 31.

If the intervals between adjacent ones of the insertion opening 55 and the mating terminal 54 deflect from each other, the front ends of the mating terminals 54 slide on the guide slope 59 of the spacer member 39 and are guided into the terminal accommodating chambers 31. As a result, in the substrate connector 27, the mating terminals 54 are inserted into the terminal accommodating chamber 31 from the other side of the housing main body 33, so that the contact portions 47 of the terminals 35 come into contact with the mating terminals 54.

The substrate connector 27 can correspond to a difference in the specification of the mating terminals 37, 54 which are disposed in different intervals by selectively inserting the mating terminals 37, 54 into the terminal accommodating chambers 31 from the one side or the other side of the housing main body 33.

SUMMARY OF THE INVENTION

However, in the related substrate connector 27, the spacer member 39 for holding the terminal 35 within the terminal accommodating chamber 31 is provided with an insertion opening 55 which allows the mating terminal 54 to be inserted into the terminal accommodating chamber 31 from the other side of the housing main body 33. A guide slope 59 formed in this insertion opening 55 guides insertion of the mating terminal 54 into the terminal accommodating chamber 31. Thus, in the substrate connector 27, the quantity of components is increased by the amount of the spacer member 39, thereby increasing cost and complicating installation work.

Accordingly, an object of the present invention is to provide a substrate connector for guiding insertion of the mating terminals into the terminal accommodating chambers from one side and the other side of the housing main body and capable of reducing the quantity of necessary components.

To achieve the above object, according to a first aspect of the present invention, there is provided a substrate connector comprising: a housing main body fixed to a substrate having a through hole and having terminal accommodating chambers; terminals which are accommodated and held in the terminal accommodating chambers and to be connected to mating terminals; an insertion opening formed on one side of the housing main body and for allowing the mating terminals to be inserted into the terminal accommodating chambers from one side of the housing main body; and an installation opening formed on the other side of the housing main body and for installing the terminals into the terminal accommodating chambers, wherein with the housing main body fixed to the substrate, the through hole in the substrate is communicated to the installation opening so that the mating terminals are allowed to be inserted into the terminal accommodating chambers from the other side of the housing main body and insertion of the mating terminals into the terminal accommodating chambers is selectively carried out corresponding to the specification of the mating terminal from one side or the other side of the housing main body, the substrate connector further comprising an insertion guide portion which is provided around the installation opening in the housing main body and guides the mating terminals into the terminal accommodating chambers when the mating terminals are inserted into the terminal accommodating chambers from the other side of the housing main body.

According to the first aspect of the present invention having such a structure, the installation opening communicates with the through hole in the substrate thereby allowing mating terminals to be inserted into the terminal accommodating chambers from the other side of the housing main body. Further, insertion of the mating terminals into the terminal accommodating chambers can be carried out selectively from one side or the other side of the housing main body corresponding to the specification of the mating terminals.

Additionally, the terminals are accommodated and held in the terminal accommodating chamber and when plural mating terminals are inserted into the terminal accommodating chambers from the other side of the housing main body, the plural mating terminals can be guided into the terminal accommodating chambers by means of an insertion guide portion formed around the installation opening.

According to a second aspect of the present invention, there is provided a substrate connector according to the first aspect further comprising: a contact portion which is formed on the one side and comes into contact with the mating terminal inserted into the terminal accommodating chamber; a soldering fixing portion which is formed on the other side and soldered to the substrate; linking portions for linking the contact portion with the soldering fixing portion; and terminal guide portions which are provided in the linking portions and guide the mating terminals to the contact portions when the mating terminals are inserted into the terminal accommodating chambers from the other side of the housing main body.

According to the second aspect of the present invention having such a structure, when inserting the mating terminals into the terminal accommodating chamber from the other side of the housing main body, the mating terminals inserted into the terminal accommodating chamber can be guided to the contact portions securely by means of the terminal guide portions formed in the linking portions of the terminal.

According to the third aspect of the present invention, there is provided a substrate connector according to the second aspect further comprising stress absorbing portions provided in the linking portions for absorbing a stress applied to the terminals.

According to the third aspect of the present invention, the stress absorbing portion for absorbing a force applied to the terminal is provided to prevent generation of crack in the soldering fixing portion.

Additionally, because even when the mating terminals are inserted into the terminal accommodating chambers in a condition that they are distorted due to their own elasticity, the contact portions are deflected due to elasticity of the stress absorbing portion corresponding to the mating terminals, the terminals can be connected to the mating terminals securely.

DESCRIPTION OF THE PREFERRED EMBODIMENTS

Figure 1A:
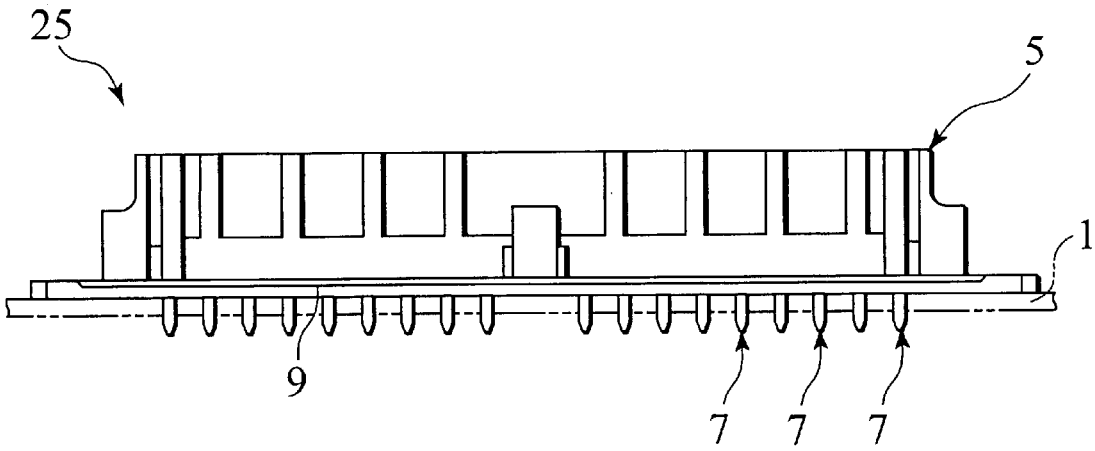
FIG. 1A is a side view showing a related substrate connector.
Figure 1B:
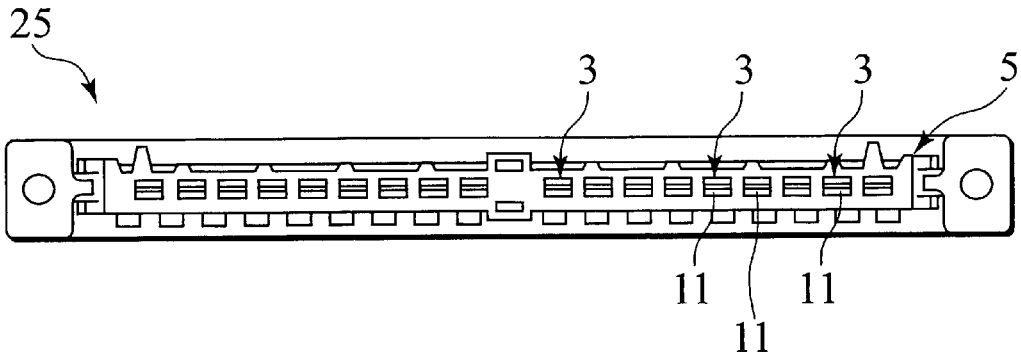
FIG. 1B is a plan view of the related substrate connector shown in FIG. 1A.
Figure 2:
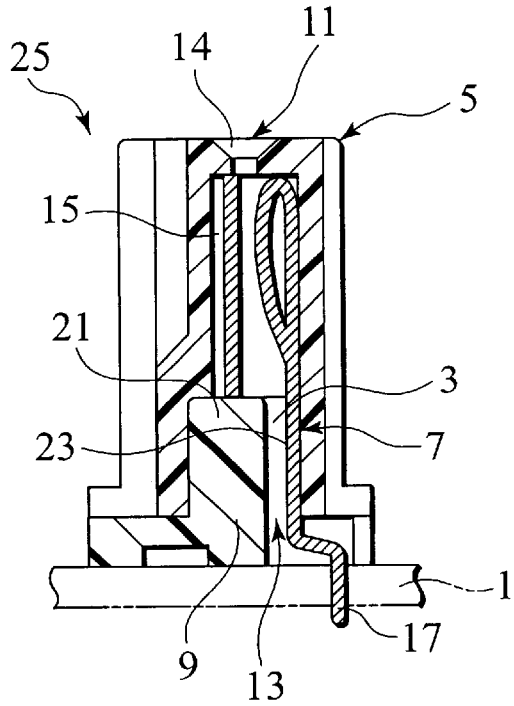
FIG. 2 is a sectional view of the related substrate connector shown in FIGS. 1A, 1B.
Figure 3A:
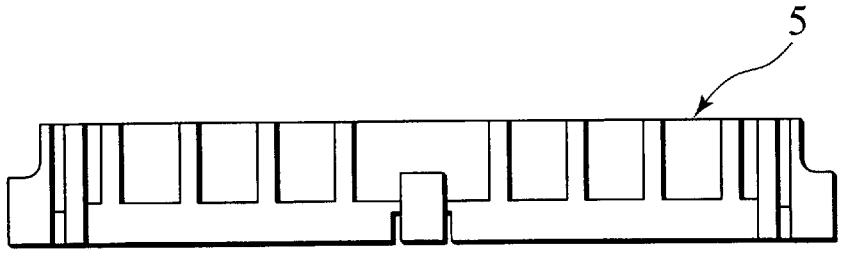
FIG. 3A is a side view of the housing main body shown in FIGS. 1A, 1B
Figure 3B:
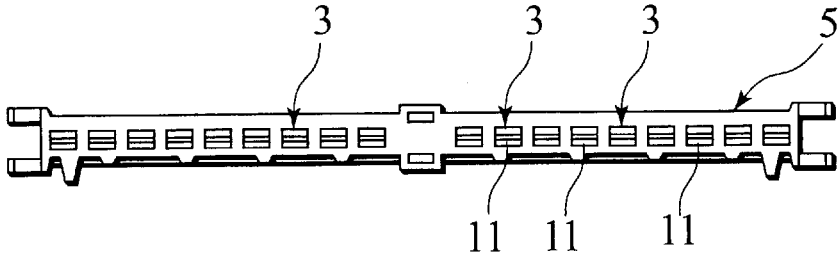
FIG. 3B is a plan view of the housing main body shown in FIG. 3A.
Figure 4A:
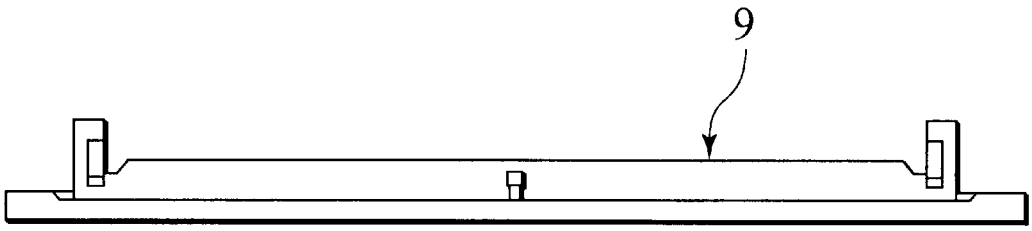
FIG. 4A is a side view of a spacer member shown in FIGS. 1A, 1B.
Figure 4B:
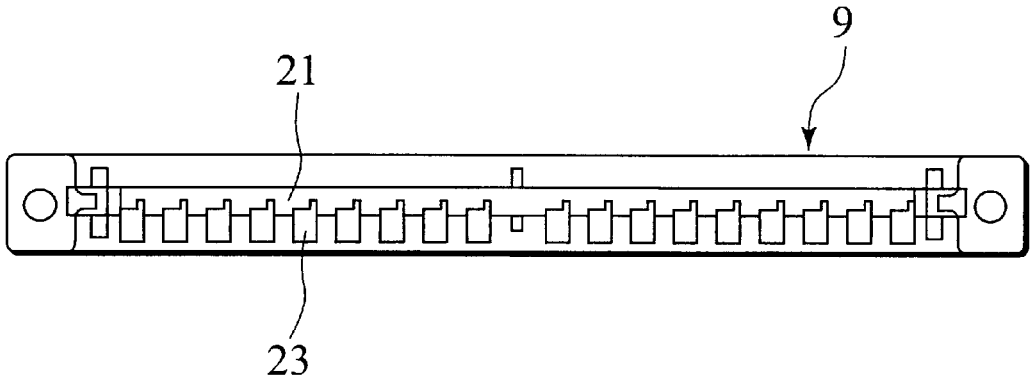
FIG. 4B is a plan view of the spacer member shown in FIG. 4A.
Figure 5A:
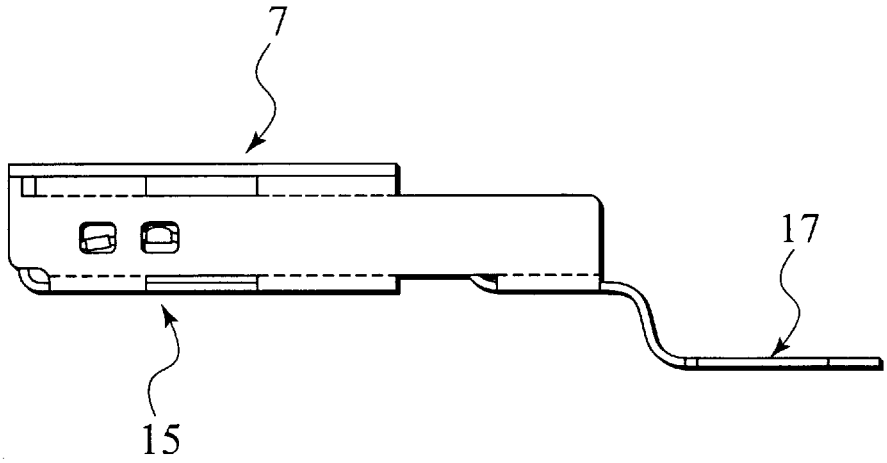
FIG. 5A is a side view of a terminal shown in FIG. 2.
Figure 5B:
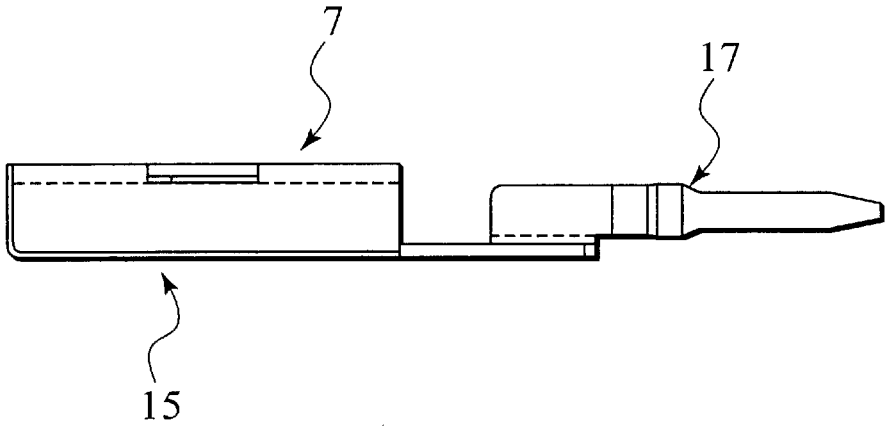
FIG. 5B is a plan view of the terminal shown in FIG. 5A.
Figure 5C:
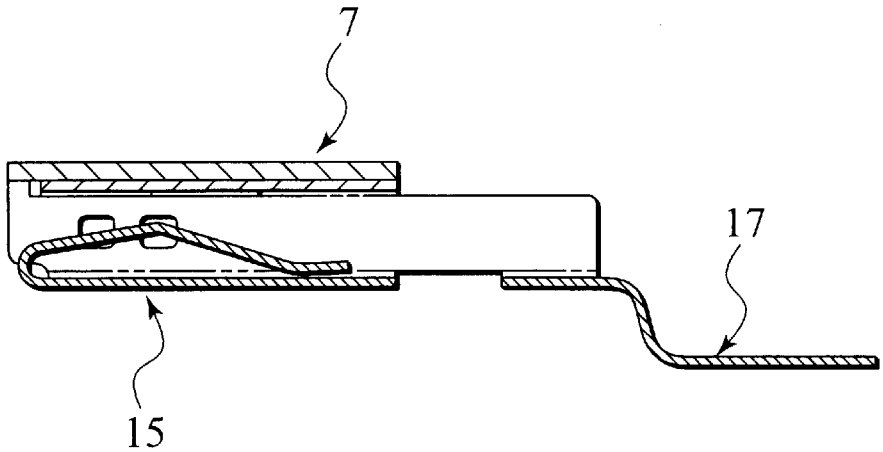
FIG. 5C is a sectional view of the terminal shown in FIG. 5A.
Figure 6:
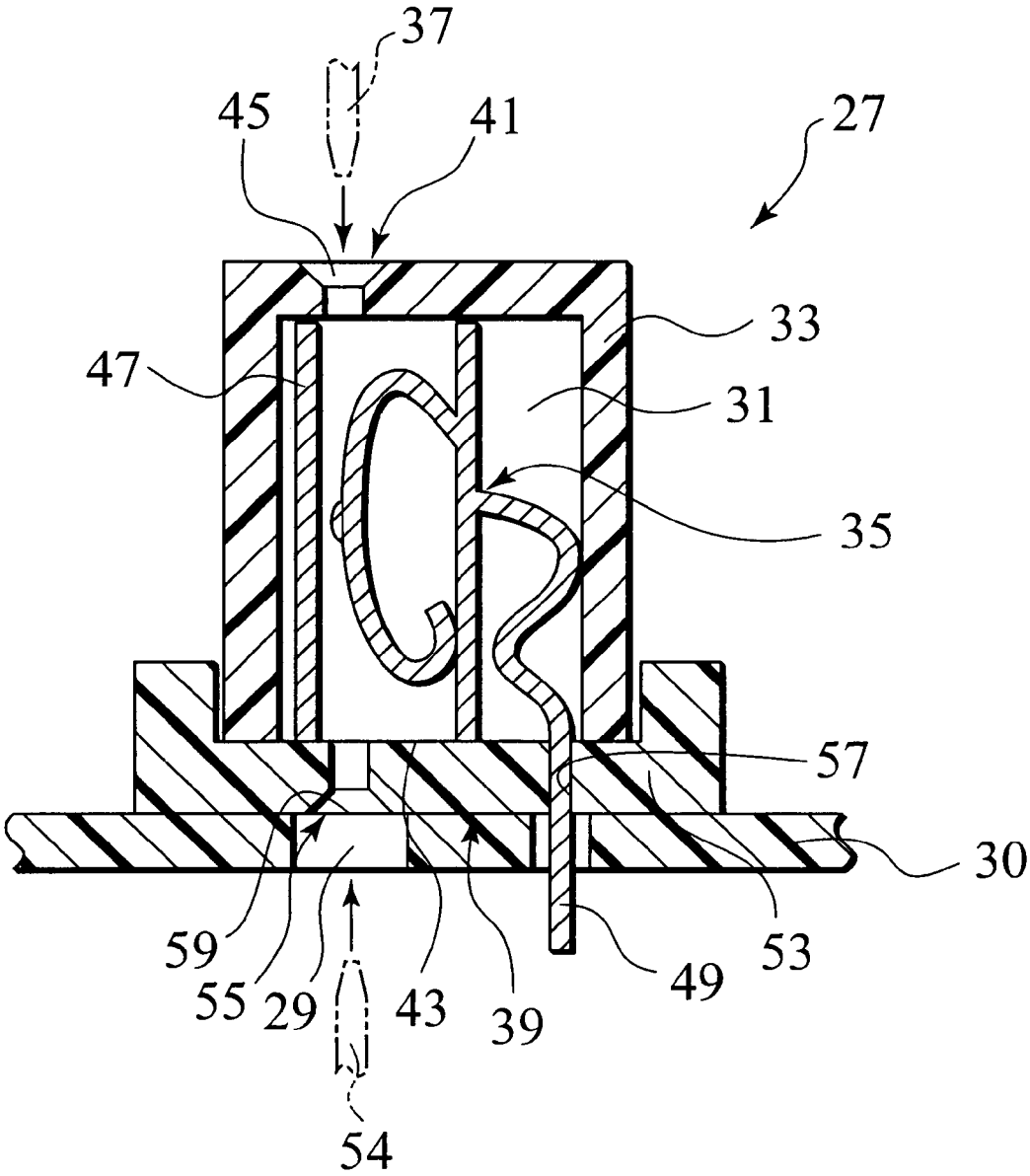
FIG. 6 is a sectional view showing other related substrate connector.
Figure 7:
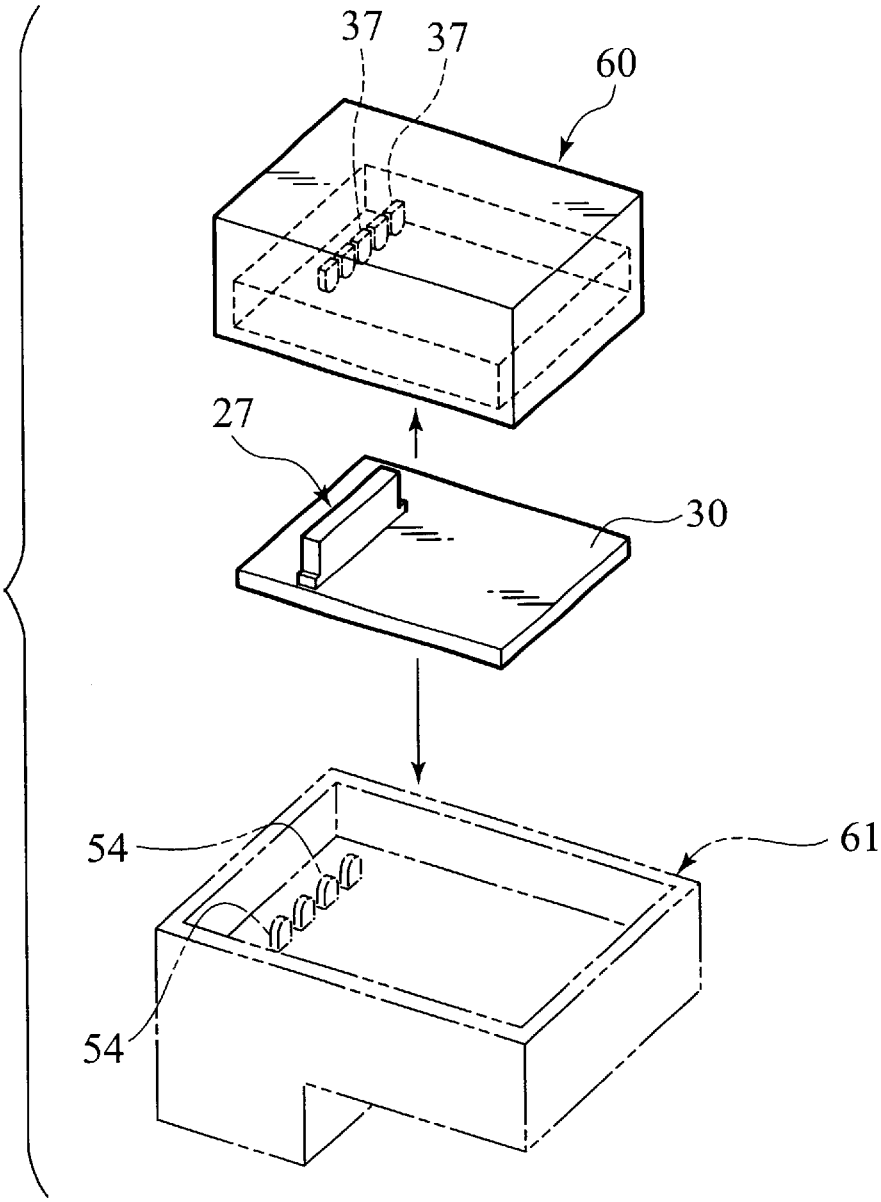
FIG. 7 is a perspective view when connecting the related substrate connector shown in FIG. 6 to a mating terminal of an electric connecting box.
Figure 8A:
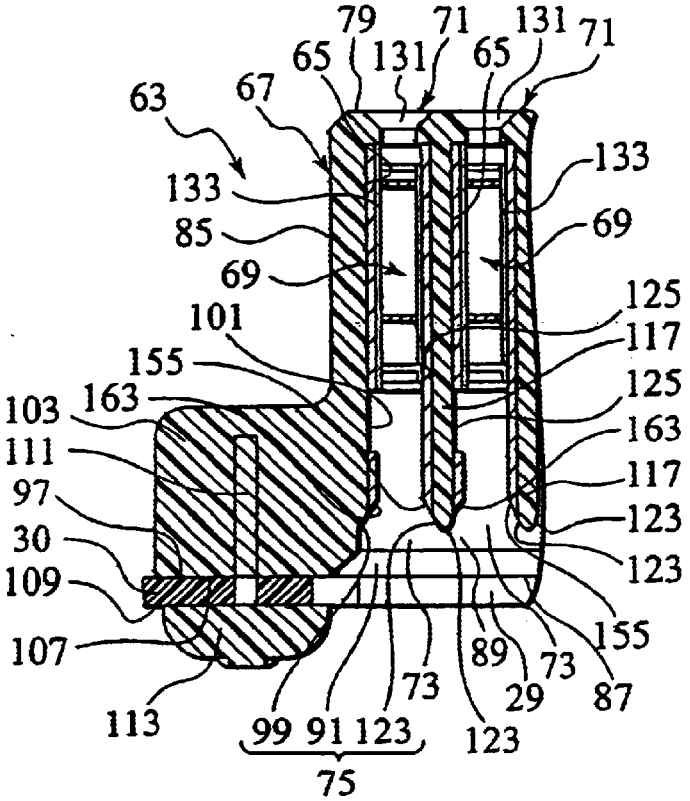
FIG. 8A is a sectional view of the substrate connector of the first embodiment of the present invention, taken along the length direction thereof
Figure 8B:
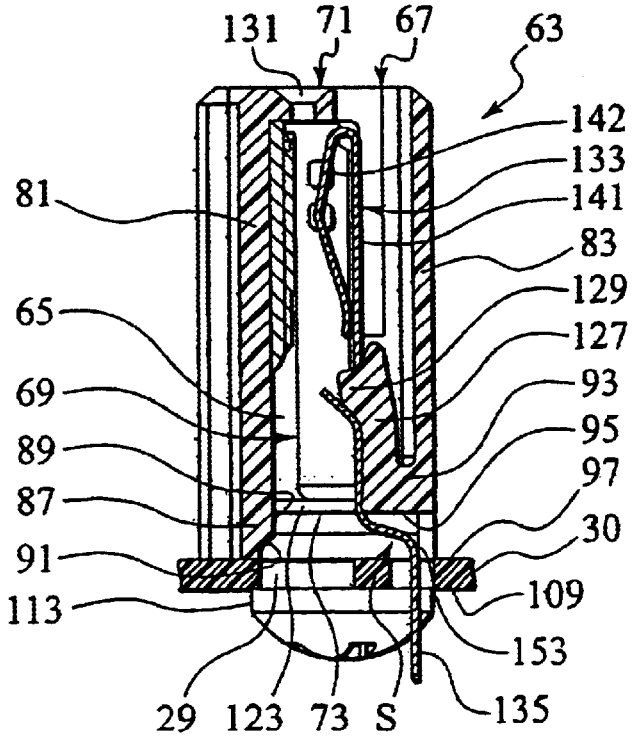
FIG. 8B is a sectional view of the substrate connector of the first embodiment of the present invention, along the width direction thereof.
Figure 9A:
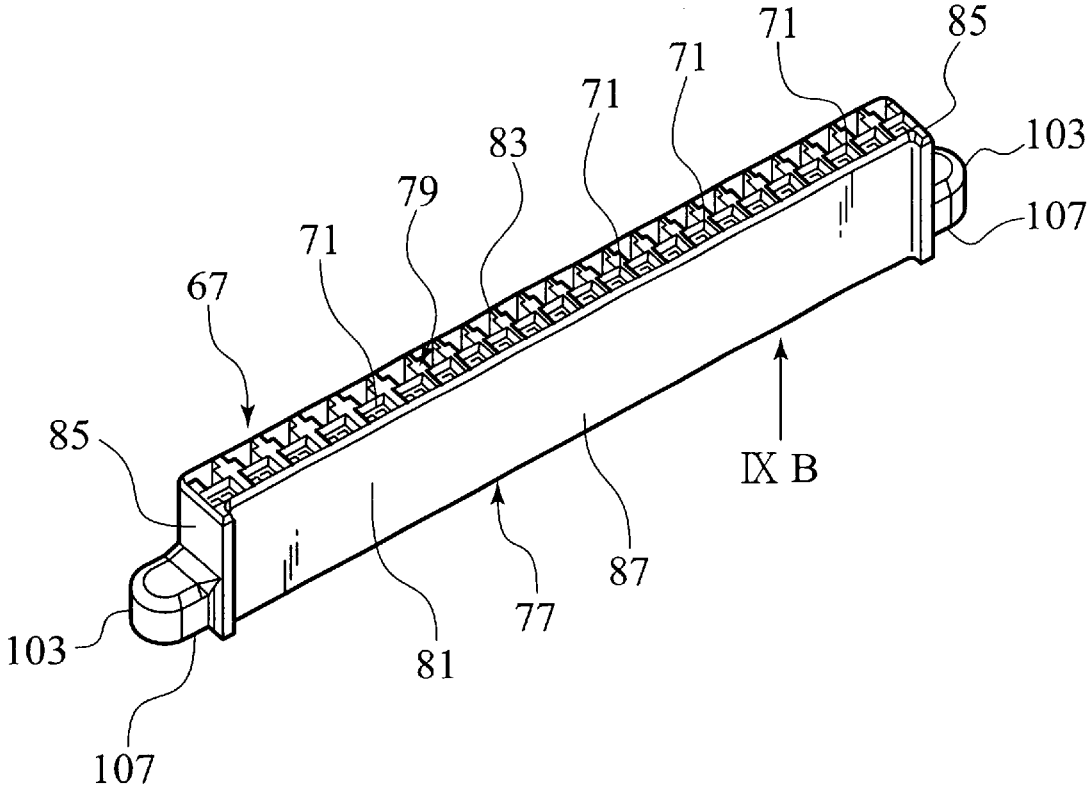
FIG. 9A is a perspective view of the housing main body shown in FIGS. 8A, 8B.
Figure 9B:
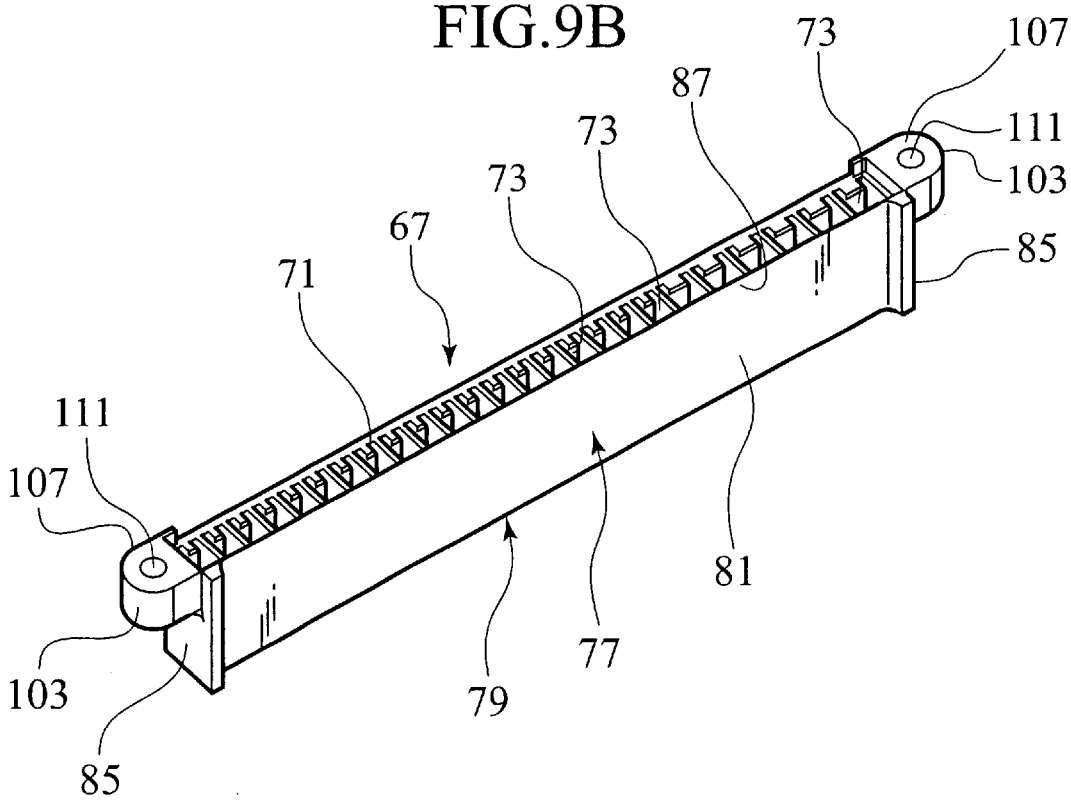
FIG. 9B is a perspective view of the housing main body shown in FIG. 9A as viewed in the direction of an arrow IXB.
Figure 10A:
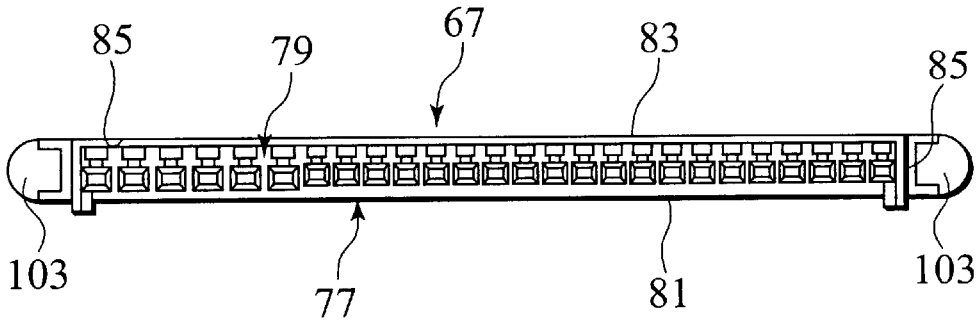
FIG. 10A is a plan view of the housing main body shown in FIGS. 8A, 8B
Figure 10B:
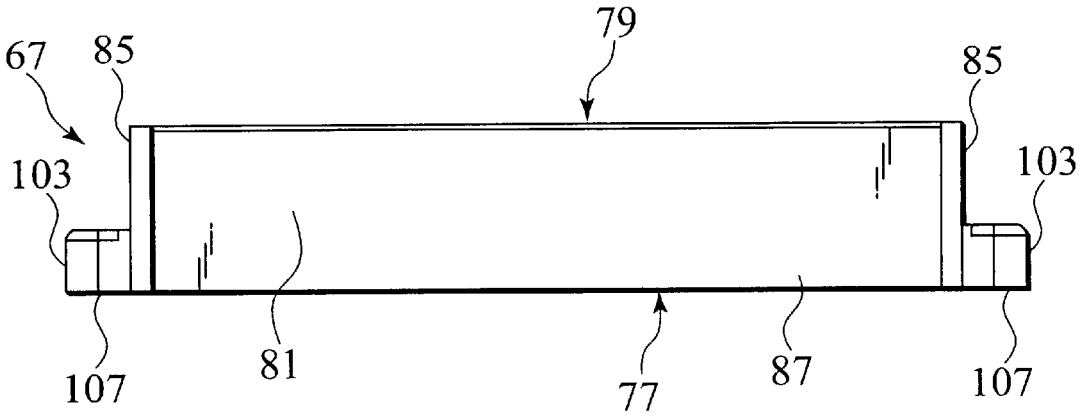
FIG. 10B is a side view of the housing main body shown in FIG. 10A.

Hereinafter, the preferred embodiment of the substrate connector of the present invention will be described. FIGS. 8A, 8B are sectional views showing the substrate connector according to a first embodiment of the present invention. FIGS. 9A, 9B are perspective views showing the housing main body shown in FIGS. 8A, 8B. FIGS. 10A, 10B are a plan view and a side view of the housing main body shown in FIGS. 8A, 8B, respectively.

A substrate connector 63 comprises a housing main body 67 which is fixed to a substrate 30 having a through hole 29 and contains a plurality of terminal accommodating chambers 65 and a plurality of terminals 69 which are accommodated in respective terminal accommodating chambers 65 so that they are connected to mating terminals (see FIGS. 8A, 8B and FIGS. 14A, 14B). As shown in FIGS. 8A, 8B, the substrate connector 63 comprises an insertion opening 71 which is formed in one side of the housing main body 67 to allow the mating terminal to be inserted into each of the plural terminal accommodating chambers 65 from the one side of the housing main body 67, an installation opening 73 which is formed in the other side of the housing main body 67 to install the terminal 69 into the terminal accommodating chamber 65 to allow the mating terminal to be inserted into the terminal accommodating chamber 65 from the other side of the housing main body 67, and an insertion guide portion 75 which is provided around the installation opening 73 of the housing main body 67 to guide the mating terminal into the terminal accommodating chamber 65 when inserting the mating terminal into the terminal accommodating chamber 65 from the other side of the housing main body 67.

The housing main body 67 comprises a cylindrical wall portion 77 having an opening with a rectangular section and a closed wall portion 79 in which one opening of this cylindrical wall portion 77 is closed (see FIGS. 9A, 9B and FIGS. 10A, 10B). The cylindrical wall portion 77 comprises rectangular sheet-like one side walls 81 and other side wall 83 formed in substantially equal shape, which are disposed such that they oppose each other and linking walls 85, 85 for linking the wall 81 with the wall 83 across both sides in the length direction. The wall 81 has a contact wall 87 provided along the length direction.

The contact wall 87 is formed in a rectangular shape by extending the wall 81 outward from the other side of the housing main body 67 (see FIGS. 8A, 8B). A front end of this contact wall 87 is in contact with an opening edge of a through hole 29 in the substrate 30 when the housing main body 67 is fixed on the substrate 30, such that an inner face 89 is disposed over the through hole 29 in the substrate 30. Then, the contact wall 87 has a slope 91 between the front end and the inner face 89.

The slope 91 is provided in the length direction of the contact wall 87 and formed such that the dimension of the contact wall 87 in the direction of its cross section is decreased from the inner face 89 of the contact wall 87 to a front end thereof. This slope 91 is disposed over the through hole 29 in the substrate 30 when the housing main body 67 is fixed on the substrate 30.

In the other side wall 83 disposed to oppose the one side wall 81 described above, when the housing main body 67 is fixed to the substrate 30, an accommodating space S for accommodating the stress absorbing portion 153 of the terminal 69 is formed between an end face 95 of a protruded portion 93 formed on the other side of the housing main body 67 and a surface 97 of the substrate 30.

The linking walls 85, 85, which link the one side wall 81 with the other side wall 83, are formed each in a rectangular shape and both sides in the width direction are formed integrally with side edges of the one side wall 81 and the other side wall 83 in the length direction (see FIGS. 9A, 9B). These linking walls 85, 85 have slopes 99, 99 provided at each front end on the other side of the housing main body 67 (see FIGS. 8A, 8B).

The slope 99 is formed in the width direction of the linking wall 85 such that its dimension in the direction of the cross section is decreased gradually from an inner side face 101 of the linking wall 85 to the front end.

The linking walls 85, 85 have fixing portions 103, 103 for fixing the housing main body 67 onto the substrate 30 (see FIGS. 8A–10B). The fixing portion 103 is formed integrally on an outside face 105 of the linking wall 85 on the other side of the housing main body 67 and protruded in the length direction of the housing main body 67 from the outside face 105 of the linking wall 85 while at the same time protruded outward from a front end on the other side of the housing main body 67 of the linking wall 85. This fixing portion 103 has a flat end face 107 formed on the other side of the housing main body 67 and this flat end face 107 is substantially flush with a front end of the contact wall 87. When fixing the housing main body 67 on the substrate 30, with the end face 107 of the fixing portion 103 in contact with the surface 97 of the substrate 30, a bolt 113 is inserted into a tightening hole 111 from a rear face 109 of the substrate 30 and tightened (see FIGS. 8A, 8B).

The aforementioned closed wall portion 79 is formed in a rectangular shape and both sides thereof in the width direction are integrated with the one side of the housing main body 67 of each of the one side wall 81 and the other side wall 83, and both sides in the length direction are integrated with the one side of the housing main body 67 of the linking walls 85, 85. This closed wall portion 79 contains a plurality of insertion openings 71, which will be described later.

As shown in FIGS. 8A, 8B, a plurality of the terminal accommodating chambers 65 are formed within the housing main body 67. The plural terminal accommodating chambers 65 are formed in a cylindrical shape at a predetermined interval in the length direction of the housing main body 67. These terminal accommodating chambers 65 are disposed between the inner side faces 101 and 101 of the linking walls 85, 85 and adjacent chambers thereof are separated by a partition wall 117.

The partition wall 117 is formed in a rectangular shape and the one side thereof in the length direction is formed integrally with an inner face of the closed wall portion 79 while the other side thereof is disposed over the other opening face. Both sides of the partition wall 117 in the width direction are formed integrally with inner side faces of the one side wall 81 and the other side wall 83 of the housing main body 67. The other side of each of the partition walls 117 in the length direction is provided with slopes 123, 123.

The slopes 123, 123 are provided along the width direction of the partition wall 117. These slopes 123, 123 are formed by decreasing an interval between both the side faces 125 and 125 in the width direction of the cross section of the partition wall 117 gradually toward each front end so that the side faces 125, 125 approach each other.

The terminal accommodating chamber 65 has a retaining piece 127 for holding the terminal 69 inside, which will be described later. The retaining piece 127 is formed in the shape of a cantilever having an elasticity such that one side thereof in the length direction is formed integrally with a protruded portion 93 formed on the other side wall 83 of the housing main body 67 while the other side is disposed on the side of the other side of the housing main body 67. A front end of this retaining piece 127 is deflectable with its proximal end as a fulcrum point between the one side wall 81 and the other side wall 83 of the housing main body 67. The front end of this retaining piece 127 has an expanded portion 129 which is expanded toward the one side wall 81. This expanded portion 129 engages an engaging hole 157 in the terminal 65 when the terminal 69 is accommodated in the terminal accommodating chamber 65, so that the terminal 69 is held in the terminal accommodating chamber 65.

The housing main body 67 has an insertion opening 71 allowing a mating terminal formed on one side to be inserted into the terminal accommodating chamber 65. The insertion opening 71 is formed in the shape of a hole and provided at a position corresponding to the terminal accommodating chamber 65 of the closed wall portion 79. This insertion opening 71 is formed to pass through the closed wall portion 79 from its inner face to its outer face so as to communicate outside of the housing main body 67 with the terminal accommodating chamber 65. The insertion opening 71 is formed smaller than the sectional shape of the terminal accommodating chamber 65. Further, the insertion opening 71 is formed in a shape substantially the same or slightly larger than the sectional shape of the mating terminal so as to allow the mating terminal to be inserted into the terminal accommodating chamber 65. The insertion opening 71 is provided with a guide slope 131 for guiding insertion of the mating terminal into the terminal accommodating chamber 65 when the mating terminal is inserted into the terminal accommodating chamber 65.

The guide slope 131 is provided on an opening edge in an outer face of the closed wall portion 79 in the insertion opening 71 and its diameter is increased gradually from the inner side to the outer side of the closed wall portion 79. This guide slope 131 allows the mating terminal to slide when the mating terminal is inserted into the terminal accommodating chamber 65 through the insertion opening 71. An installation opening 73 is formed in the other side of the housing main body 67 in which the insertion opening 71 is formed on the one side, in order to install the terminal 69, which will be described later, in the terminal accommodating chamber 65.

The installation openings 73 are formed by sectioning the other opening of the housing main body 67 by the front ends of the partition walls 117. This installation opening 73 is formed in a shape substantially the same or slightly larger than the sectional shape of a contact portion 133 of the terminal 69 described later. The installation opening 73 communicates with the through hole 29 in the substrate 30 when the housing main body 67 is fixed on the substrate 30 so as to allow the mating terminal to be inserted into the terminal accommodating chamber 65 from the other side of the housing main body 67. An insertion guide portion 75 is formed around this installation opening 73 to guide insertion of the mating terminal into the terminal accommodating chamber 65 from the other side of the housing main body 67.

The insertion guide portion 75 is formed of the slopes 99, 99 formed on the linking walls 85, 85, the slopes 123, 123 formed on the partition wall 117 and the slope 91 provided on the contact wall 87.

This insertion guide portion 75 guides the mating terminal inserted along the slope 91 of the contact wall 87 in the width direction of the housing main body 67 in the terminal accommodating chambers 65 disposed on both sides in the length direction of the housing main body 67. Further, the inserted mating terminal is guided in the length direction of the housing main body by the slope 99 on the linking wall 85 and the slope 123 on the partition wall 117 opposing the linking wall 85 across the terminal accommodating chamber 65. The insertion guide portion 75 guides the mating terminal 69 inserted by the slope 91 on the contact wall 87 in the width direction of the housing main body 67 in the terminal accommodating chamber 65 disposed between the partition walls 117 and 117, while the slopes 123, 123 on the partition walls 117 opposing each other across the terminal accommodating chamber 65 guide the inserted mating terminal in the length direction of the housing main body 67.

Figure 11:
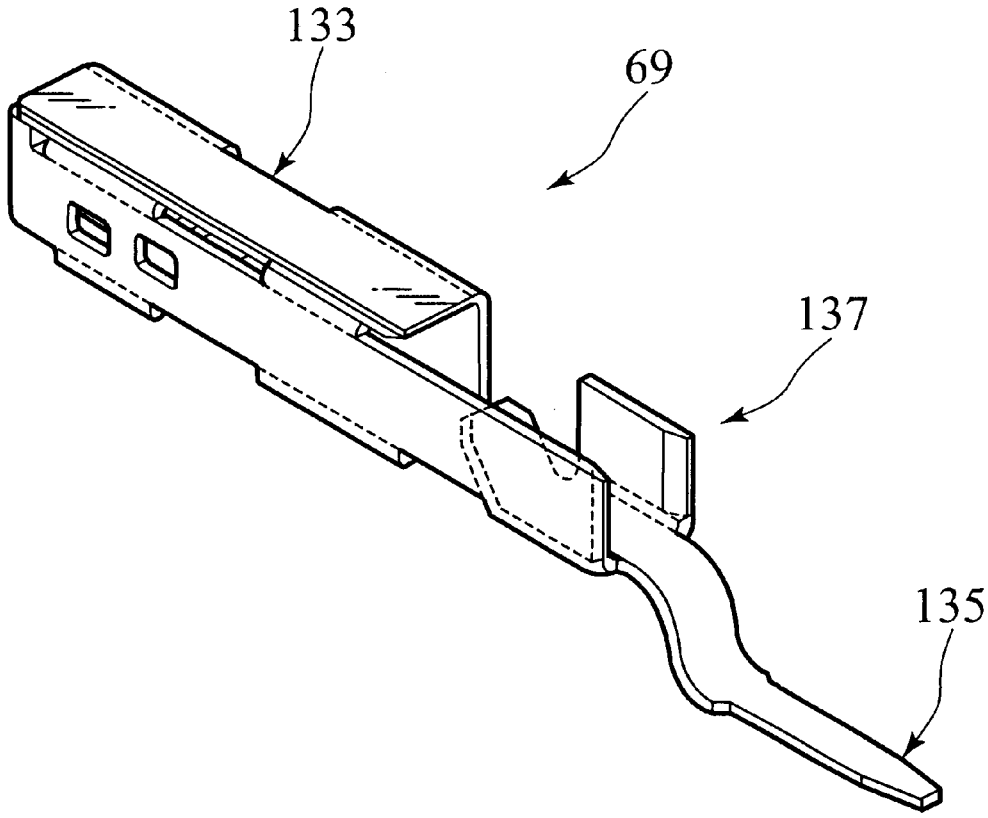
FIG. 11 is a perspective view of a terminal shown in FIGS. 8A, 8B.
Figure 12A:
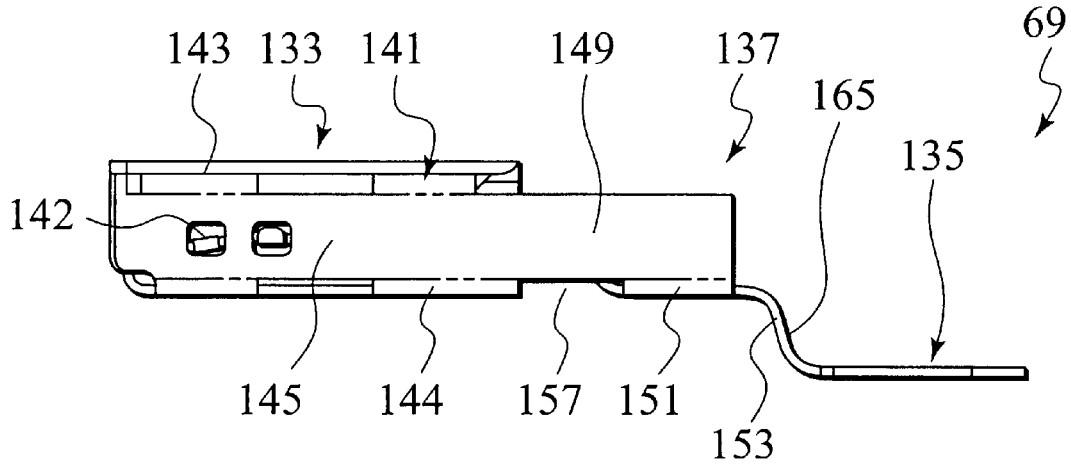
FIG. 12A is a side view of the terminal shown in FIG. 11.
Figure 12B:
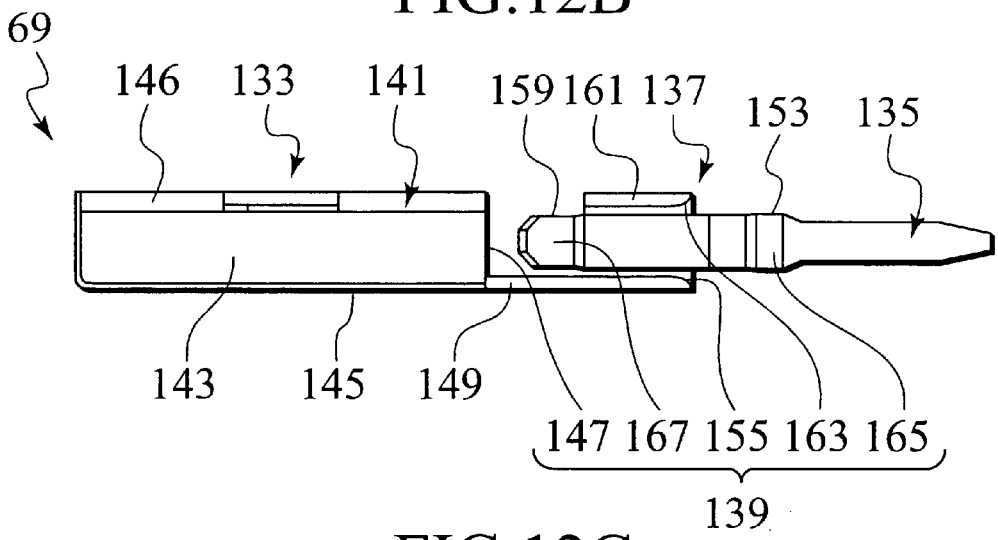
FIG. 12B is a plan view of the terminal shown in FIG. 12A.
Figure 12C:
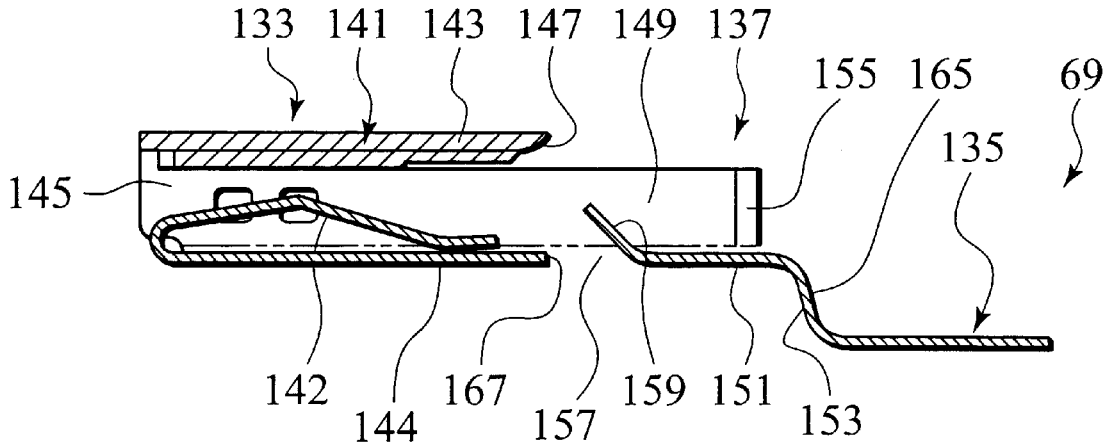
FIG. 12C is a sectional view of the terminal shown in FIG. 12A.

As shown in FIG. 11, the terminal 69 to be installed in the housing main body 67 comprises a contact portion 133 which is formed on one side and comes into contact with the mating terminal inserted into the terminal accommodating chamber 65, a soldering fixing portion 135 which is formed on the other side and to be soldered on the substrate 30, a linking portion for linking the contact portion 133 with the soldering fixing portion 135 and a terminal guide portion 139 which is provided in this linking portion 137 and guides the mating terminal into the contact portion 133 when the mating terminal is inserted from the other side of the housing main body 67 into the terminal accommodating chamber 65. The contact portion 133 is accommodated in the terminal accommodating chamber 65 and comprises a cylindrical contact portion main body 141 and an elastic contact piece 142 formed inside this contact portion main body 141 (see FIGS. 12A–12C).

The contact portion main body 141 is formed in a long hallow form and allows a mating terminal to be inserted therein through openings formed on both sides in the length direction. This contact portion main body 141 is comprised of rectangular sheet-like side walls 143, 144 disposed to oppose each other and intersecting walls 145, 146 having substantially the same shape as the side walls 143, 144 and disposed so as to interest the side walls 143, 144. In the contact portion main body 141, the side wall 143 which is to be disposed on the one side wall 81 of the housing main body 67 has a slope 147 when the terminal 69 is accommodated in the terminal accommodating chamber 65.

The slope 147 is provided on a front end formed on the other side of the terminal 69 of the side wall 143 in the width direction of the side wall 143. In this slope 147, the dimension thereof in the width direction of its cross section is decreased gradually from the inner face of the side wall 143 toward a front end and the front end is in contact with an inner side face of the one side wall 81 of the housing main body 67.

The aforementioned contact portion main body 141 contains the elastic contact piece 142 for nipping the mating terminal inserted inside together with the side wall 143. The elastic contact piece 142 is formed in a sheet-like shape and is joined to the contact portion main body 141 through a curved portion to possess elasticity. This elastic contact piece 142 is bent with its intermediate portion as a fulcrum point so that the intermediate portion comes into an elastic contact with the mating terminal inserted inside through an opening in the contact portion main body 141.

The soldering fixing portion 135, which is to be soldered and fixed on the substrate 30, is provided on the other side of the terminal 69 having such a contact portion 133. The soldering fixing portion 135 is formed in a rectangular sheet-like form and passed through a through hole so that it is soldered and fixed on a rear face 109 of the substrate 30.

As described above, the terminal 69 has the linking portion 137 for linking the contact portion 133 with the soldering fixing portion 135. The linking portion 137 includes a extended wall 149 extended from the contact portion 133, a joint wall 151 for jointing this extended wall 149 with the soldering fixing portion 135 and a stress absorbing portion 153 formed between this joint wall 151 and the soldering fixing portion 135.

The extended wall 149 is formed in a rectangular sheet-like form and one intersecting wall 145 of the contact portion main body 141 is extended toward the other side of the terminal 69. When the terminal 69 is accommodated in the terminal accommodating chamber 65, a front end of this extended wall 149 is disposed near an opening edge of the installation opening 73. The extended wall 149 allows the contact portion 133 to be deflected in the terminal accommodating chamber 65 due to its elasticity. The extended wall 149 has a slope 155 provided at a front end formed on the other side of the terminal 69.

The slope 155 is provided along the width direction of the extended wall 149 such that a dimension of the extended wall 149 in the direction of its cross section is decreased gradually from an inner face thereof toward the front end. As shown in FIGS. 8A, 8B, when the terminal 69 is accommodated in the terminal accommodating chamber 65, a front end of this slope 155 is in contact with the side face 125 of the partition wall 117 or the inner side face 101 of the linking wall 85, so that it is substantially flush with the slopes 123, 99 of the partition wall 117 and the linking wall 85. This extended wall 149 is connected to the soldering fixing portion 135 through the linking wall 151.

The joint wall 151 is formed in a rectangular sheet-like shape and molded integrally with the extended wall 149 in the length direction and protruded toward the other intersecting wall 146 such that it intersects the extended wall 149. This joint wall 151 is stretched from a front end of the extended wall 149 up to an intermediate portion. An engaging hole 157 which the retaining piece 127 of the terminal accommodating chamber 65 engages is formed between one side edge of the terminal accommodating chamber 65 and the other side wall 144 of the contact portion 133. The joint wall 151 has an inclined wall 159 provided on a side edge of the terminal 69 and includes the stress absorbing portion 153, which will be described later, on the other side edge of the terminal 69.

The inclined wall 159 is formed in a rectangular sheet-like form and one side thereof in the length direction is formed integrally with a side edge of the terminal 69 of the joint wall 151 as a proximal end, while the other side is disposed on the one side of the terminal 69 as a front end. The other side acts as a front end disposed on one side of the terminal 69. This inclined wall 159 is formed such that a front end thereof is directed toward the slope 147 provided on one side wall 143 of the contact portion 133 and inclined toward the one side wall 143 of the contact portion 133 gradually from the other side to the one side of the housing main body 67.

Further, the joint wall 151 has an opposing wall 161 disposed to oppose the extended wall 149. The opposing wall 161 is formed integrally in a rectangular sheet-like form along the length direction of the joint wall 151 while it is protruded toward the one side wall 143 such that it intersects the joint wall 151. This opposing wall 161 has a slope 163 provided at a front end thereof on the other side of the terminal 69.

The slope 163 is formed such that a dimension of the opposing wall 161 in a width direction is decreased gradually from the inner face of the opposing wall 161 to a front end. When the terminal 69 is accommodated in the terminal accommodating chamber 65, a front end of this slope 163 is in contact with the side face 125 of the partition wall 117 or the inner side face 101 of the linking wall 85, so that it is substantially flush with the slope 123, 99 of the partition wall 117 or the linking wall 85 (see FIGS. 8A, 8B).

The aforementioned stress absorbing portion 153 is formed by bending a portion between the joint wall 151 of the terminal 69 and the soldering fixing portion 135 and has an elasticity. This stress absorbing portion 153 has an inclined portion 165 which is inclined toward the other side of the terminal 69 from the side of the joint portion 151 to the side of the soldering fixing portion 135. When the terminal 69 is accommodated in the terminal accommodating chamber 65, the stress absorbing portion 153 is accommodated in an accommodating space S formed between the housing main body 67 and the substrate 30 (see FIGS. 8A, 8B). The stress absorbing portion 153 allows the contact portion 133 to be deflected within the terminal accommodating chamber 65 because of its own elasticity.

The linking portion 137 formed in this way is provided with a terminal guide portion 139 for guiding the mating terminal to the contact portion 133 when the mating terminal is inserted into the terminal accommodating chamber 65 from the other side of the housing main body 67. The terminal guide portion 139 comprises a slope 155 formed on the extended wall 149, a slope 163 provided on the opposing wall 161, the inclined portion 165 provided on the stress absorbing portion 153, an inner face 167 formed on the inclined wall 159 and the slope 147 of the contact portion main body 141 (see FIGS. 12A–12C).

Figure 13A:
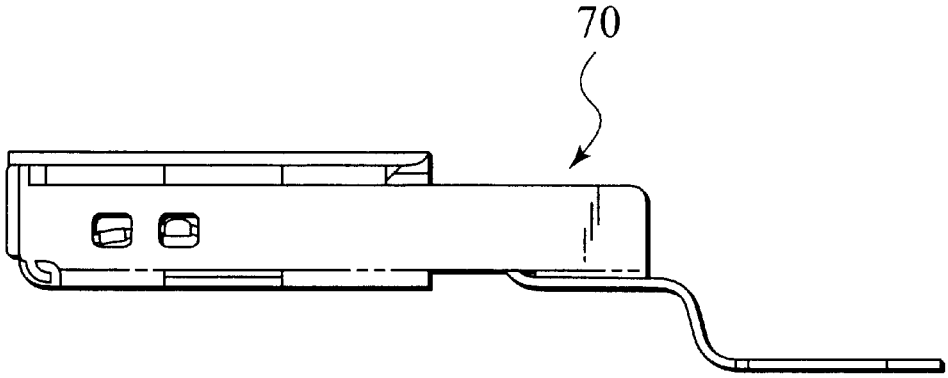
FIG. 13A is a side view showing other terminal for use in the substrate connector shown in FIGS. 8A, 8B.
Figure 13B:
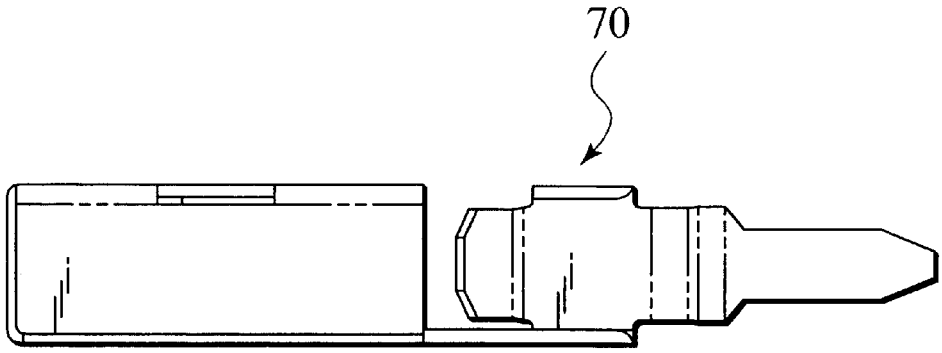
FIG. 13B is a plan view of the terminal shown in FIG. 13A
Figure 13C:
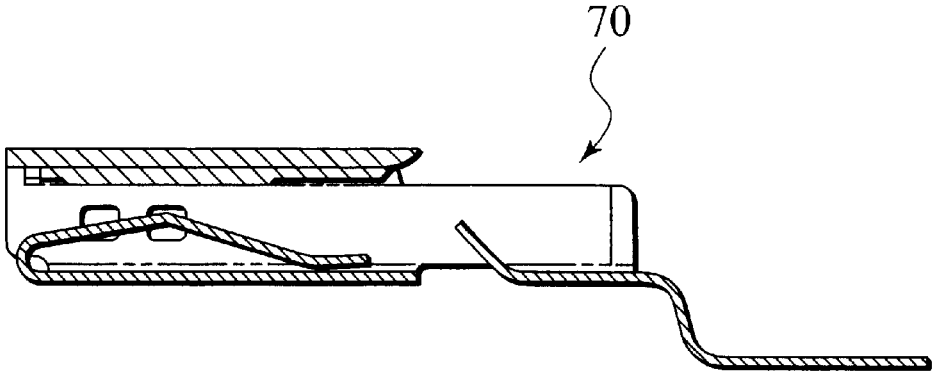
FIG. 13C is a sectional view of the terminal shown in FIG. 13A.
Figure 14A:
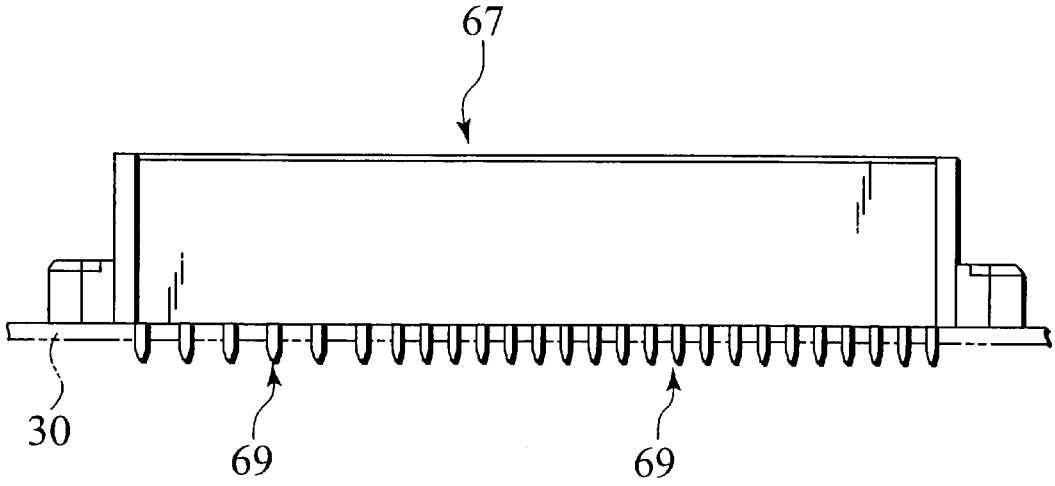
FIG. 14A is a side view of the substrate connector shown in FIGS. 8A, 8B
Figure 14B:
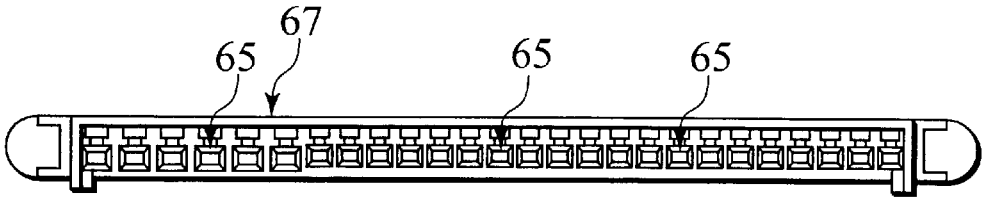
FIG. 14B is a plan view of the substrate connector shown in FIG. 14A.

The terminal guide portion 139 guides the inserted mating terminal in the width direction of the housing main body 67 by means of the inclined portion 165 of the stress absorbing portion 153, the inner face 167 of the inclined wall 155 and the slope 147 of the contact portion main body 141. Further, the terminal guide portion 139 guides the inserted mating terminal in the length direction of the housing main body 67 by means of the slope 155 formed on the extended wall 149 and the slope 163 provided on the opposing wall 161. In the substrate connector 63, as shown in FIGS. 13A–13C, a terminal 70 formed in a larger width than the terminal 69 is utilized as well as the terminal 69. This terminal 70 has the same configuration as the terminal 69.

When plural mating terminals of an electric connecting box or the like are connected to plural terminals 69, 70 in the substrate connector 63 having such a configuration, an interval between adjacent terminals may differ and the mating terminals are inserted selectively into the terminal accommodating chamber 65 from one side or the other side of the housing main body 67 depending on the specification of the plural mating terminals.

When the mating terminals are inserted into the terminal accommodating chamber 65 from the one side of the housing main body 67, first, the plural mating terminals are matched with the plural insertion openings 71 in the housing main body 67. After that, the substrate 30 is moved to the side of the mating terminal from the surface 95.

If the intervals between adjacent ones of the plural mating terminals and the plural insertion openings 71 are unmatched, if the substrate 30 is moved to the side of the mating terminal, the front ends of the plural mating terminals come into contact with the guide slope 131 of each of the plural insertion openings 71. If the substrate 30 is moved further to the side of the mating terminal with this condition, the front ends of the plural mating terminals slide on the guide inclined face 131 to be guided into the insertion opening 71. As a result, the plural mating terminals are inserted into the terminal accommodating chambers 65 through the insertion opening 71, so that they come into contact with the contact portion 133 of each of the terminals 69, 70 thereby achieving conductivity with the plural terminals 69, 70.

With this condition, the plural mating terminals are inserted into the terminal accommodating chambers 65 such that they are distorted due to their own elasticity. Corresponding to these distorted mating terminals, the contact portion 133 is deflected within the terminal accommodating chamber 65 due to elasticity of the extended wall 149 and the stress absorbing portion 153. Thus, the contact portion 133 is connected to the mating terminal securely.

As a result, even if the interval between adjacent ones of the plural mating terminals and the plural insertion openings 71 are deflected, the deflection of this interval is absorbed so that the plural mating terminals are inserted into the terminal accommodating chamber 65 from the one side of the housing main body 67 and the plural terminals 69, 70 are connected to the plural mating terminals securely.

Figure 15A:
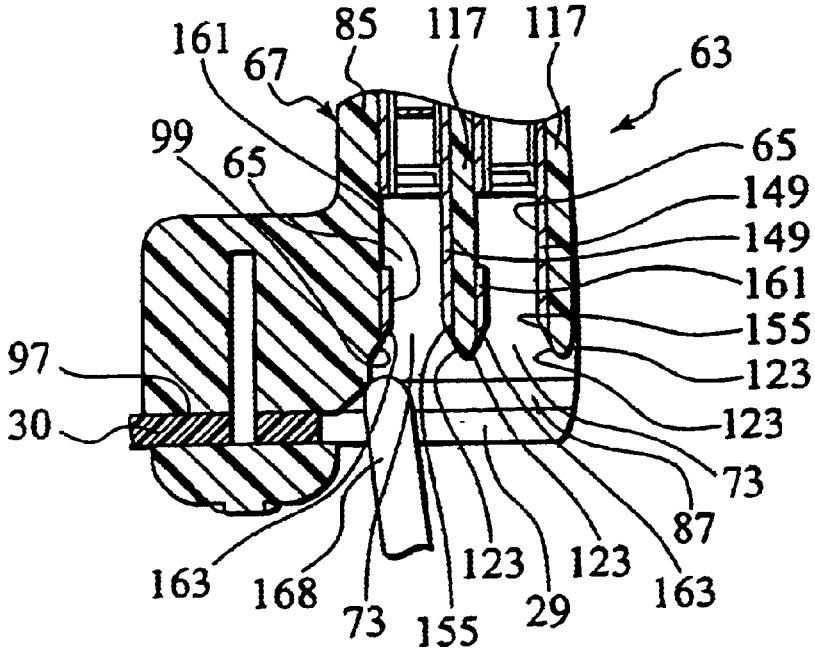
FIG. 15A is a sectional view when a mating terminal is inserted into the substrate connector shown in FIG. 8A
Figure 15B:
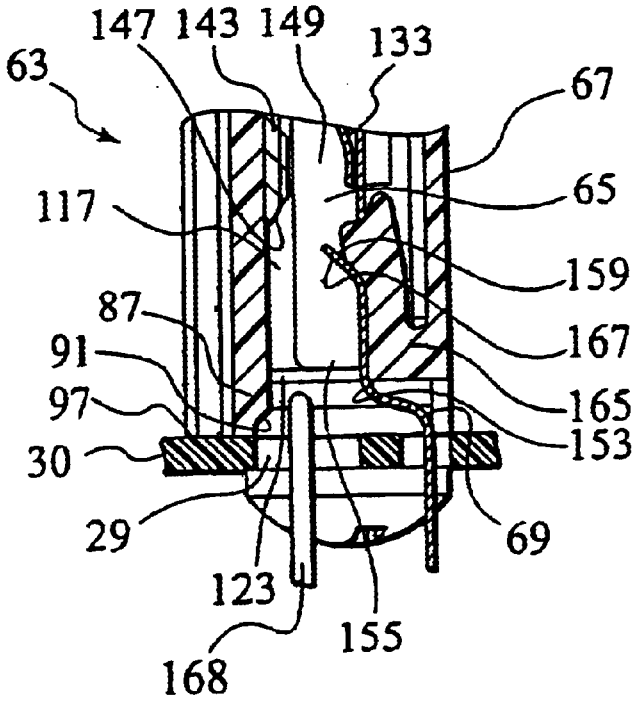
FIG. 15B is a sectional view when a terminal is inserted into the substrate connector shown in FIG. 8B.

When trying to insert plural mating terminals 168 having such an interval between adjacent ones not allowing them to be inserted into the terminal accommodating chambers 65 from one side of the housing main body 67, they are inserted from the other side of the housing main body 67 as shown in FIGS. 15A, 15B.

When trying to insert the plural mating terminals 168 into the terminal accommodating chamber 65 from the other side of the housing main body 67, first, the plural mating terminals 168 are matched with the installation opening 73 of the housing main body 67. After that, the substrate 30 is moved from the rear face 109 to the side of the mating terminal 168. In this case, the plural mating terminals 168 are guided into the terminal accommodating portion 65 from the insertion guide portion 75 and the terminal insertion portion 139.

If the substrate 30 is moved to the side of the mating terminals, the plural mating terminals are inserted in between the other side of the housing main body 67 and an opening face on the side of the surface 97 of the substrate 30 through the through hole 29 in the substrate 30. At this time, the front ends of the plural mating terminals 168 slide on the slope 91 of the contact wall 87 and the inclined portion 165 of the stress absorbing portion 153, so that they are guided toward the terminal accommodating chamber 65 in the width direction of the housing main body 67.

If the substrate 30 is moved to the mating terminals 168 with this condition, the plural mating terminals 168 are inserted into the terminal accommodating chambers 65. At this time, the front ends of the mating terminals 168 disposed on both sides in the length direction of the housing main body 67 slide on the slopes 99 of the linking walls 85 and the slopes 123 of the partition walls 117 opposing the linking wall 85 across each terminal accommodating chamber 65. Consequently, the mating terminals 168 are guided to the side of the terminal accommodating chambers 65 in the length direction of the housing main body 67. Further, the front ends of these mating terminals 168 slide the slope 155 of the extended wall 149 and the slope 163 of the opposing wall 161 of the terminal 69, 70 (not shown), which is substantially flush with the slope 99 of the linking wall 85 and the slope 123 of the partition wall 117. Consequently, the mating terminals 168 on both sides in the length direction of the housing main body 67 are guided to the side of the terminal accommodating chambers 65 and inserted into the terminal accommodating chambers 65 through the installation opening 73.

The front ends of the plural mating terminals 168 disposed between the both sides of the housing main body 67 slide on the slopes 123, 123 of the partition walls 117, 117 opposing each other across each terminal accommodating chamber 65. As a result, the mating terminals 168 are guided into the terminal accommodating chamber 65 in the length direction of the housing main body 67. Further, the front ends of the plural mating terminals 168 slide on the slope 155 of the extended wall 149 and the slope 163 of the opposing wall 161 of the terminal 69, 70, which is substantially flush with the slope 123, 123 of the partition walls 117, 117 opposing each other. Thus, the front ends of the plural mating terminals 168 are guided into the terminal accommodating chambers 65 and inserted into the terminal accommodating chamber 65 through the installation opening 73.

With this condition, the plural mating terminals 168 are disposed between the extended wall 149 of the terminal 69, 70 and the opposing wall 161 so that the length direction of the housing main body 67 is determined.

Then, if the substrate 30 is moved to the side of the mating terminal 168, the plural mating terminals 168 are inserted into the terminal accommodating chamber 65 completely. At this time, the front ends of the plural mating terminals 168 slide on at least the inner face 167 of the slope 159 of the terminal 69, 70 or the slope 147 of the side wall 143, the mating terminals are guided into the inside of the contact portion 133.

As a result, the plural mating terminals 168 are inserted into the terminal accommodating chambers 65 completely through the installation opening 73 and in contact with the contact portions 133 of the terminal 69, 70, thereby achieving conductivity with the plural terminals 69, 70. In this condition, the plural mating terminals 168 are inserted into the terminal accommodating chambers 65 in a condition that they are distorted due to their own elasticity and corresponding to these distorted mating terminals 168, the contact portions 133 are deflected within the terminal accommodating chambers 65 because of elasticity of the extended wall 149 and the stress absorbing portion 153.

As a result, the plural mating terminals 168 having such an interval between adjacent ones which cannot be inserted into the terminal accommodating chamber 65 from one side of the housing main body 67 also can be inserted into the terminal accommodating chambers 65 securely from the other side of the housing main body 67, thereby making it possible to connect the plural terminals 69, 70 to the plural mating terminals 168 securely.

In the substrate connector 63 of this embodiment, the installation opening 73 entirely communicates with the through hole 29 in the substrate 30 and the installation opening 73 itself functions as an insertion opening allowing the mating terminals to be inserted into the terminal accommodating chambers 65 from the other side of the housing main body 67. As a result, insertion of the plural mating terminals into the terminal accommodating chambers 65 can be carried out selectively from one side or the other side of the housing main body 67, thereby making it possible to correspond to mating terminals of different specifications which are different in the interval between adjacent ones or the like.

In the substrate connector 63, the terminals 69, 70 are accommodated and held in the terminal accommodating chambers 65 and when inserting the plural mating terminals into the terminal accommodating chambers 65 from the other side of the housing main body 67, the plural mating terminals can be guided into the terminal accommodating chambers 65 by means of the terminal guide portion 75 formed around the installation opening 73. For the reason, in the substrate connector 63, the quantity of parts can be reduced by omitting a portion corresponding to the spacer member of a related substrate connector thereby reducing cost and facilitating installation work. Consequently, the installation work efficiency can be improved.

In the substrate connector 63 of this embodiment, when the plural mating terminals are inserted into the terminal accommodating chambers 65 from the other side of the housing main body 67, the plural mating terminals can be guided into the terminal accommodating chambers 65 and inserted securely by means of a terminal guide portion 139 formed in an linking portion 137 of the terminal 69, 70 and the mating terminals inserted into the terminal accommodating chamber 65 can be guided to the contact portion 133 of the terminal 69, 70 securely. Thus, the substrate connector 63 allows the plural terminals 69, 70 to be connected to the plural mating terminals securely.

The substrate connector 63 is provided with a stress absorbing portion 153 for absorbing a force applied to the terminals 69, 70. Thus, a force due to thermal expansion of the terminals 69, 70 and the housing main body 67 and a force applied to the terminal 69, 70 when inserting the mating terminal into the terminal accommodating chamber 65 are absorbed thereby preventing generation of crack in the soldering fixing portion 135.

In the substrate connector 63, even if the plural mating terminals are inserted into the terminal accommodating chamber 65 in a condition that the plural mating terminals are distorted because of their own elasticity, the contact portions 133 are deflected corresponding to the mating terminals because of the elasticity of the extended wall 149 and the stress absorbing portion 153. Thus, the mating terminals and terminals 69, 70 can be connected to each other securely, thereby making it possible to correspond to a difference in the specification such as a difference in the interval between terminals disposed adjacent. Although, in the above-described embodiment, the insertion guide portion 75 and the terminal guide portion 139 guide the mating terminals into the terminal accommodating chambers 65 and the contact portions 133 in the length direction and width direction of the housing main body 67, they may guide in any one of the length direction and the width direction.

Although the linking portion 137 of the terminal 69, 70 possesses the stress absorbing portion 153, it is permissible to omit the stress absorbing portion 153. In this case, the contact portion 87 of the housing main body 67 may be omitted and the accommodating space S for accommodating the stress absorbing portion 153 may be also omitted.

What is claimed is:

1. A substrate connector comprising:

a housing main body fixed to a substrate having a through hole, the housing main body having terminal accommodating chambers;

terminals accommodated and held in the terminal accommodating chambers, the terminals configured to be connected to mating terminals;

an insertion opening formed on one side of the housing main body, the insertion opening configured to allow the mating terminals to be inserted into the terminal accommodating chambers from one side of the housing main body; and an installation opening formed on the other side of the housing main body, the installation opening configured to allow the installation of the terminals in the terminal accommodating chambers, wherein the through hole in the substrate is in communication with the installation opening, and the through hole and installation opening are configured to allow the mating terminals to be inserted into the terminal accommodating chambers from the other side of the housing main body, the insertion of the mating terminals into the terminal accommodating chambers being selectively carried out, based on the specification of the mating terminals, on one side of the housing main body or the other side of the housing main body, wherein the substrate connector further comprises an insertion guide portion provided around the installation opening in the housing main body, the insertion guide portion configured to guide the mating terminals into the terminal accommodating chambers when the mating terminals are inserted into the terminal accommodating chambers from the other side of the housing main body.

2. The substrate connector of claim 1, further comprising:

a contact portion in the terminal accommodating chamber, the contact portion configured to come into contact with the mating terminal inserted into the terminal accommodating chamber;

a soldering fixing portion at least a portion of which is in the terminal accommodating chamber, the soldering fixing portion being soldered to the substrate;

linking portions that link the contact portion to the soldering fixing portion; and terminal guide portions on the linking portions, the terminal guide portions configured to guide the mating terminals to the contact portions when the mating terminals are inserted into the terminal accommodating chambers from the other side of the housing main body.

3. The substrate connector of claim 2, further comprising stress absorbing portions on the linking portions, the stress absorbing portions configured to absorb stress applied to the terminals.

4. The substrate connector of claim 1, further comprising a cantilevered retaining piece on an inner side face of the housing, wherein an expanded portion on one side of the retaining piece engages an engaging hole provided in each of the terminals.

5. The substrate connector of claim 1, wherein the insertion opening has a guide slope for guiding the mating terminal into the terminal accommodating chamber.

6. The substrate connector of claim 3, wherein the stress absorbing portion is accommodated in an accommodating space provided between the housing main body and the substrate when the terminals are accommodated in the terminal accommodating chamber.

7. A substrate connector comprising:

a housing main body fixed to a substrate having a through hole, the housing main body comprising:

terminals accommodated and held in terminal accommodating chambers, the terminals configured to be connected to mating terminals;

an insertion opening on a first side of the housing main body, the insertion opening configured to allow a first set of mating terminals to be inserted into the terminal accommodating chambers through the insertion opening, the first set of mating terminals having a first configuration; and an installation opening on a second side of the housing main body, the installation opening being in communication with the through hole in the substrate and configured to allow the installation of the terminals in the terminal accommodating chambers through the installation opening;

wherein the through hole in the substrate and the installation opening are configured to allow the insertion of a second set of mating terminals into the terminal accommodating chambers through the through hole in the substrate and the installation opening, the second set of mating terminals having a second configuration different from the first configuration, and the installation opening being configured so as to not allow the first set of mating terminals to be inserted into the terminal accommodating chambers through the installation opening.

8. The substrate connector of claim 7, further comprising:

a contact portion in the terminal accommodating chamber, the contact portion configured to come into contact with the mating terminal inserted into the terminal accommodating chamber;

a soldering fixing portion at least a portion of which is in the terminal accommodating chamber, the soldering fixing portion being soldered to the substrate;

linking portions that link the contact portion to the soldering fixing portion; and terminal guide portions on the linking portions, the terminal guide portions configured to guide the mating terminals to the contact portions when the mating terminals are inserted into the terminal accommodating chambers from the second side of the housing main body.

9. The substrate connector of claim 8, further comprising stress absorbing portions on the linking portions, the stress absorbing portions configured to absorb stress applied to the terminals.

10. The substrate connector of claim 7, further comprising a cantilevered retaining piece on an inner side face of the housing, wherein an expanded portion on one side of the retaining piece engages an engaging hole provided in each of the terminals.

11. The substrate connector of claim 7, further comprising an insertion guide portion provided around the installation opening in the housing main body, the insertion guide portion configured to guide the mating terminals into the terminal accommodating chambers when the mating terminals are inserted into the terminal accommodating chambers from the second side of the housing main body;

wherein the insertion opening has a guide slope for guiding the mating terminal into the terminal accommodating chamber.

12. The substrate connector of claim 9, wherein the stress absorbing portion is accommodated in an accommodating space provided between the housing main body and the substrate when the terminals are accommodated in the terminal accommodating chamber.

* * * * *